US007347770B2

(12) United States Patent
Ohkura

(10) Patent No.: US 7,347,770 B2
(45) Date of Patent: Mar. 25, 2008

(54) TWO-SIDED SURFACE GRINDING APPARATUS

(75) Inventor: Kenji Ohkura, Yao (JP)

(73) Assignee: Koyo Machine Industries Co., Ltd., Osaka (JP)

( * ) Notice: Subject to any disclaimer, the term of this patent is extended or adjusted under 35 U.S.C. 154(b) by 42 days.

(21) Appl. No.: 10/587,227

(22) PCT Filed: Sep. 16, 2004

(86) PCT No.: PCT/JP2004/013526

§ 371 (c)(1),
(2), (4) Date: Jul. 24, 2006

(87) PCT Pub. No.: WO2005/070620

PCT Pub. Date: Aug. 4, 2005

(65) Prior Publication Data

US 2007/0161334 A1 Jul. 12, 2007

(30) Foreign Application Priority Data

Jan. 22, 2004 (JP) ..... 2004-013908

(51) Int. Cl.
*B24B 7/00* (2006.01)

(52) U.S. Cl. ..... 451/262; 451/268; 451/269

(58) Field of Classification Search ..... 451/7, 451/132, 190, 194, 261, 262, 268, 269, 274, 451/394, 158, 302, 143
See application file for complete search history.

(56) References Cited

U.S. PATENT DOCUMENTS 5,989,108 A * 11/1999 Ikeda et al. ..... 451/268
6,652,358 B1 * 11/2003 Ikeda et al. ..... 451/8
6,726,525 B1 * 4/2004 Kato et al. ..... 451/5
7,150,674 B2 * 12/2006 Okura ..... 451/8

FOREIGN PATENT DOCUMENTS

| | | |
|---|---|---|
| JP | 11-77496 | 3/1999 |
| JP | 2000-280155 | 10/2000 |
| JP | 2001-170862 | 6/2001 |
| JP | 2003-124167 | 4/2003 |

* cited by examiner

*Primary Examiner*—Dung Van Nguyen
(74) *Attorney, Agent, or Firm*—Jordan and Hamburg LLP

(57) ABSTRACT

A two-sided surface grinding apparatus capable of eliminating undulations of concentric circles produced in the work surfaces by grinding, thereby further improving the degree of flatness of the work surfaces after grinding includes a pair of support pads which hold work outwardly of grinding whetstones and noncontactly support the work by the pressure of fluid are formed with notches corresponding to the grinding whetstones and extending from the outer edge to the center, and their noncontact support surfaces are provided with a plurality of pockets having fluid supply holes, and a mesh section forming banks around the peripheries of these pockets, the mesh section being composed of a peripheral edge disposed along the outer periphery of the noncontact support surface, and inside veins disposed so as to divide the inside of the peripheral edges and connected to the inside-and-outside connecting sections. The portion of the peripheral edge which extends along the notch is not provided with any inside-and-outside connecting section in the region excluding at least the vicinity of a central position of the work.

4 Claims, 10 Drawing Sheets

[Fig. 1]
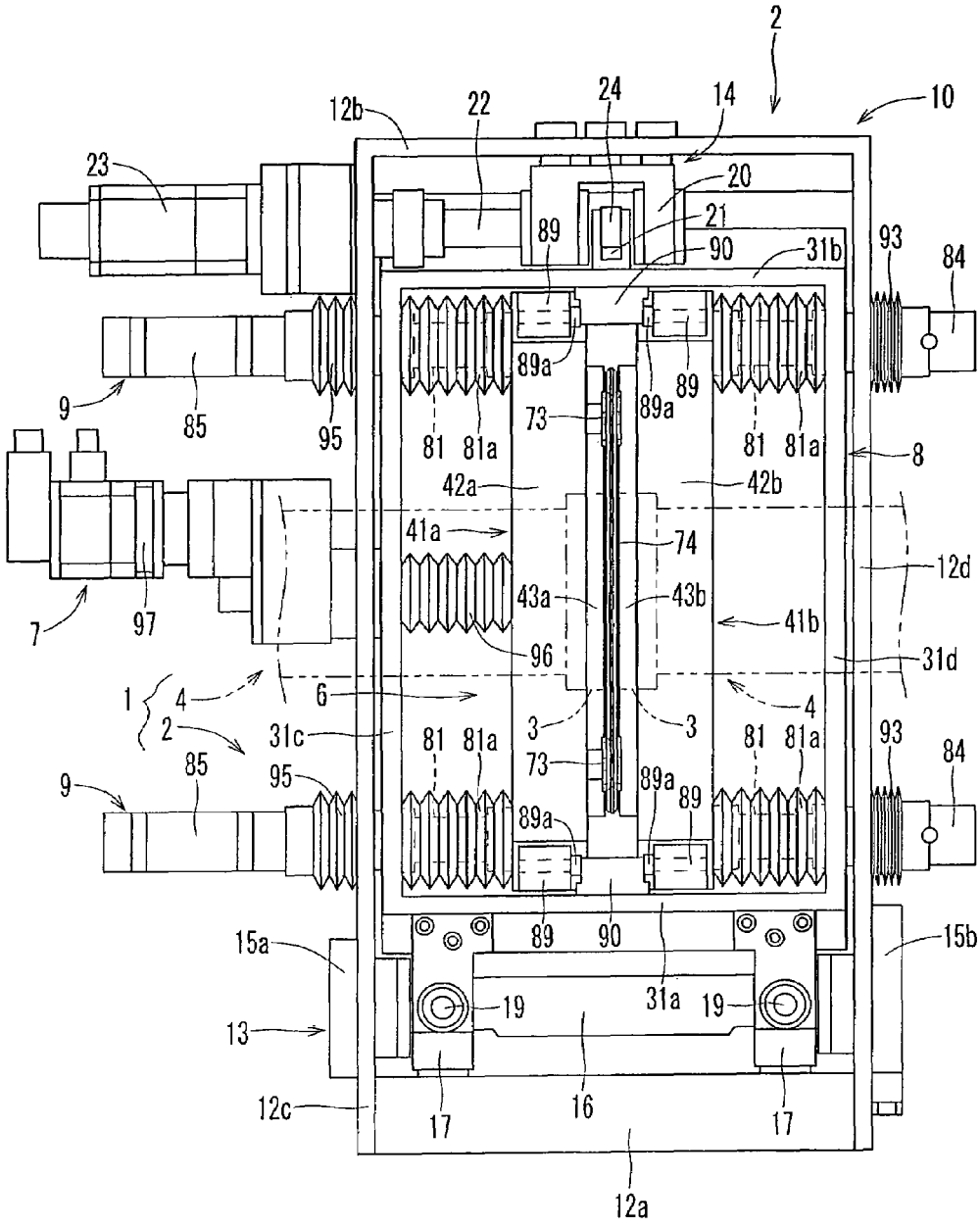

[Fig. 2]
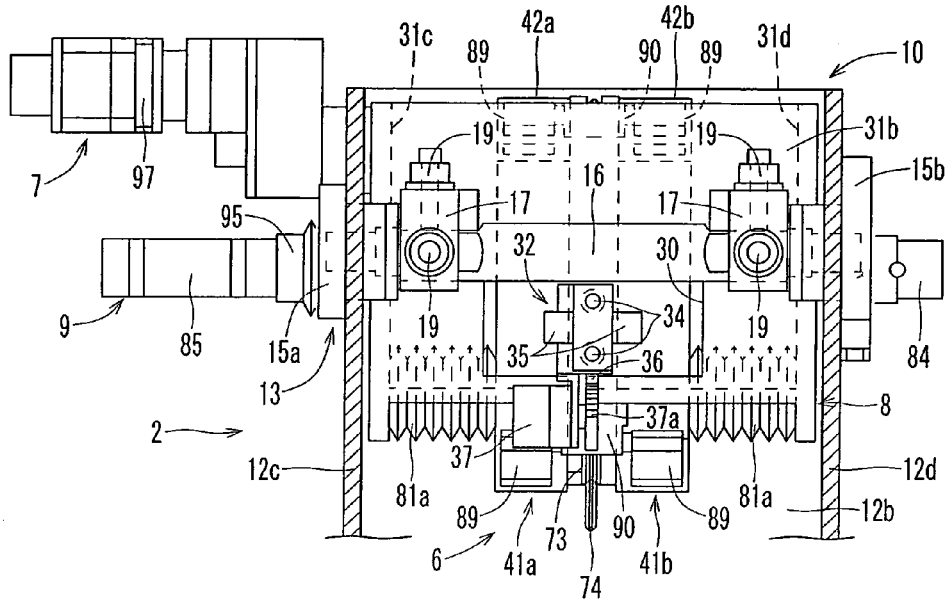
[Fig. 3]
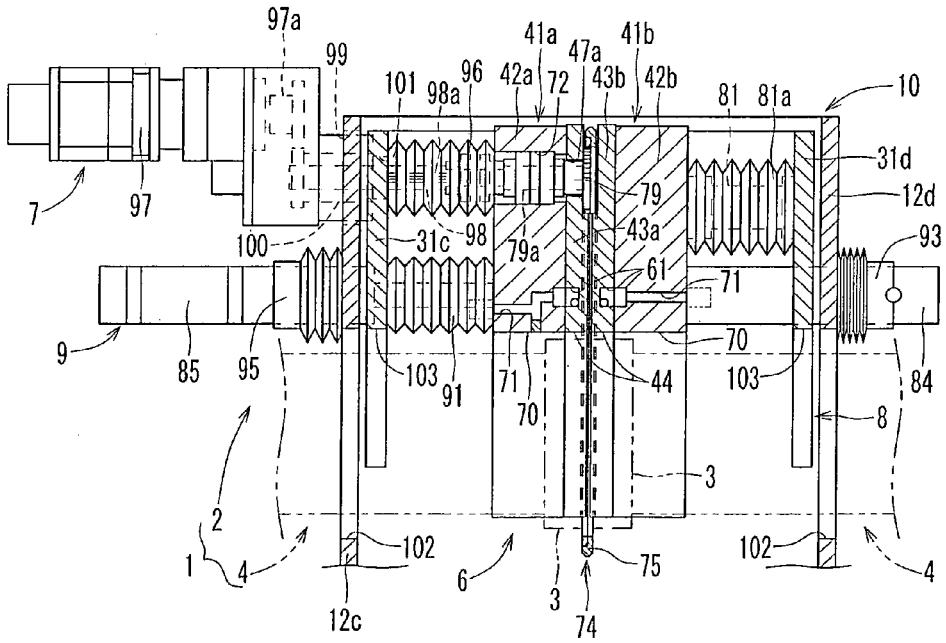

[Fig. 4]
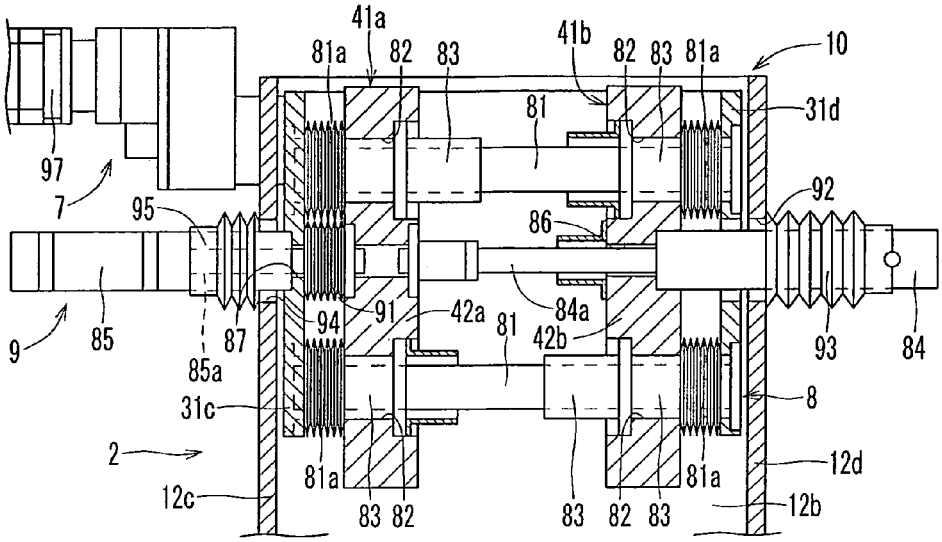
[Fig. 5]
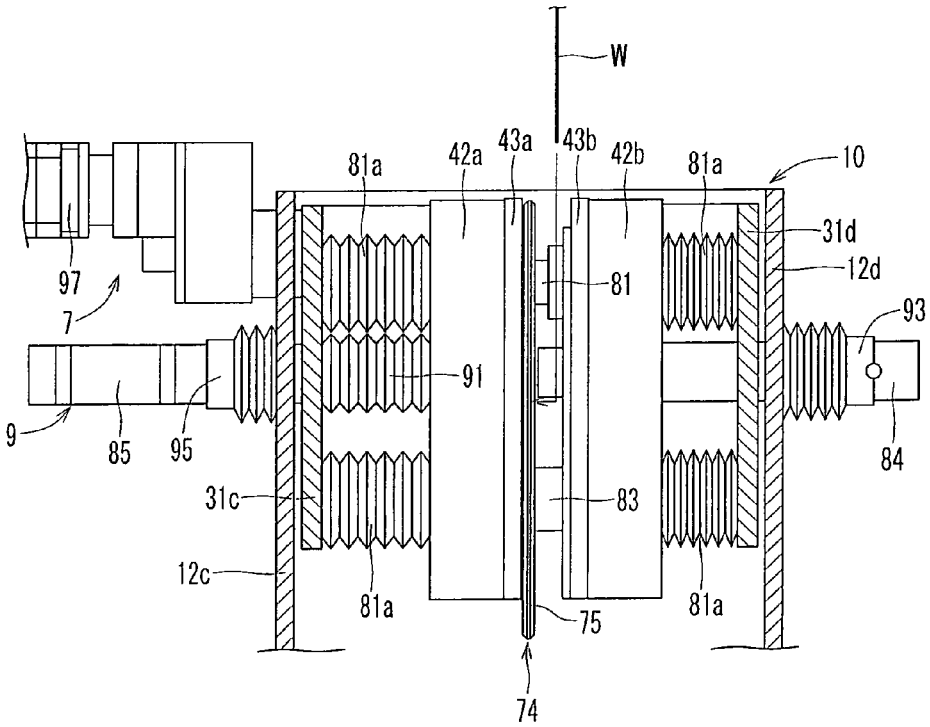

[Fig. 6]
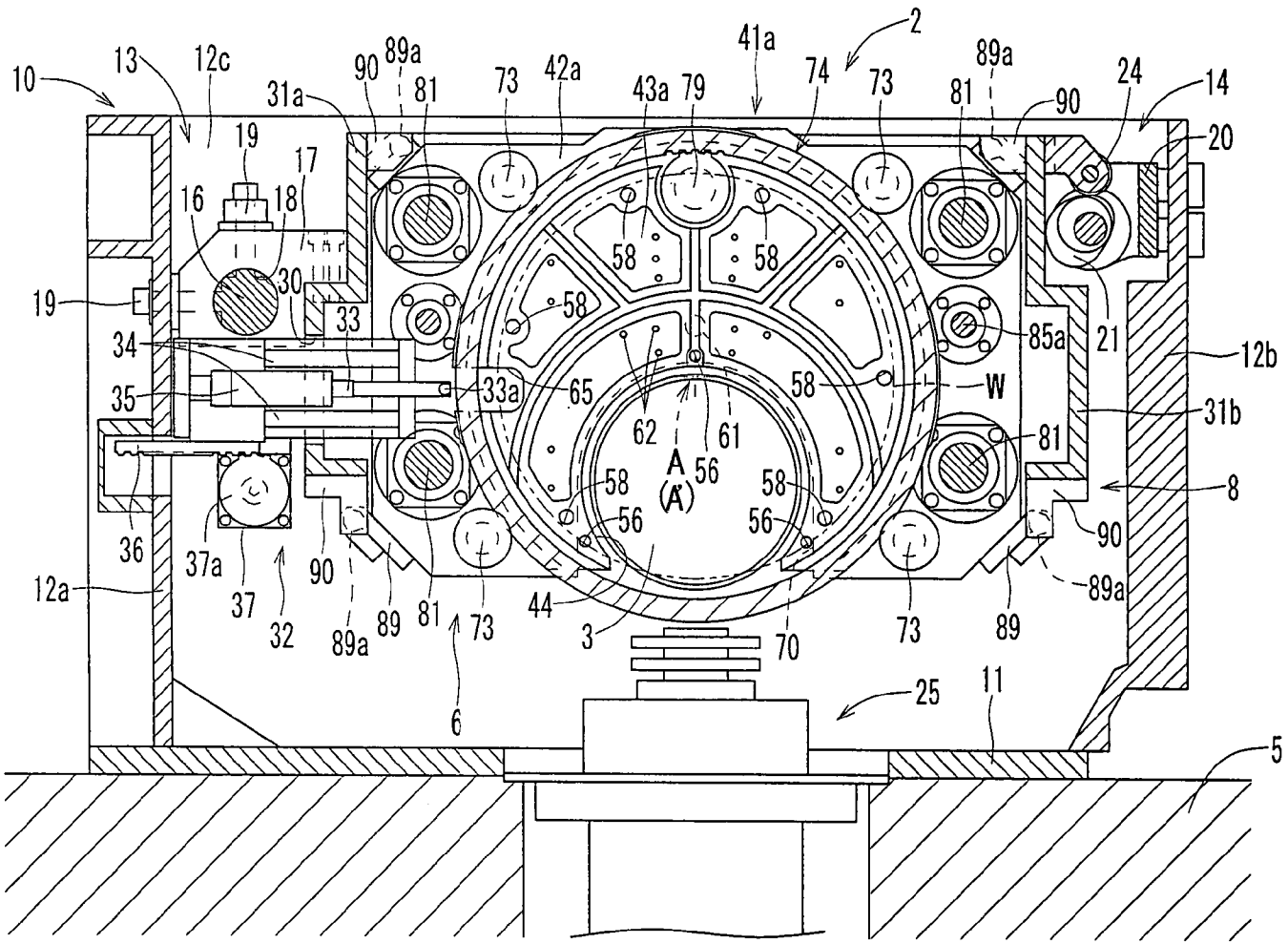

[Fig. 7]
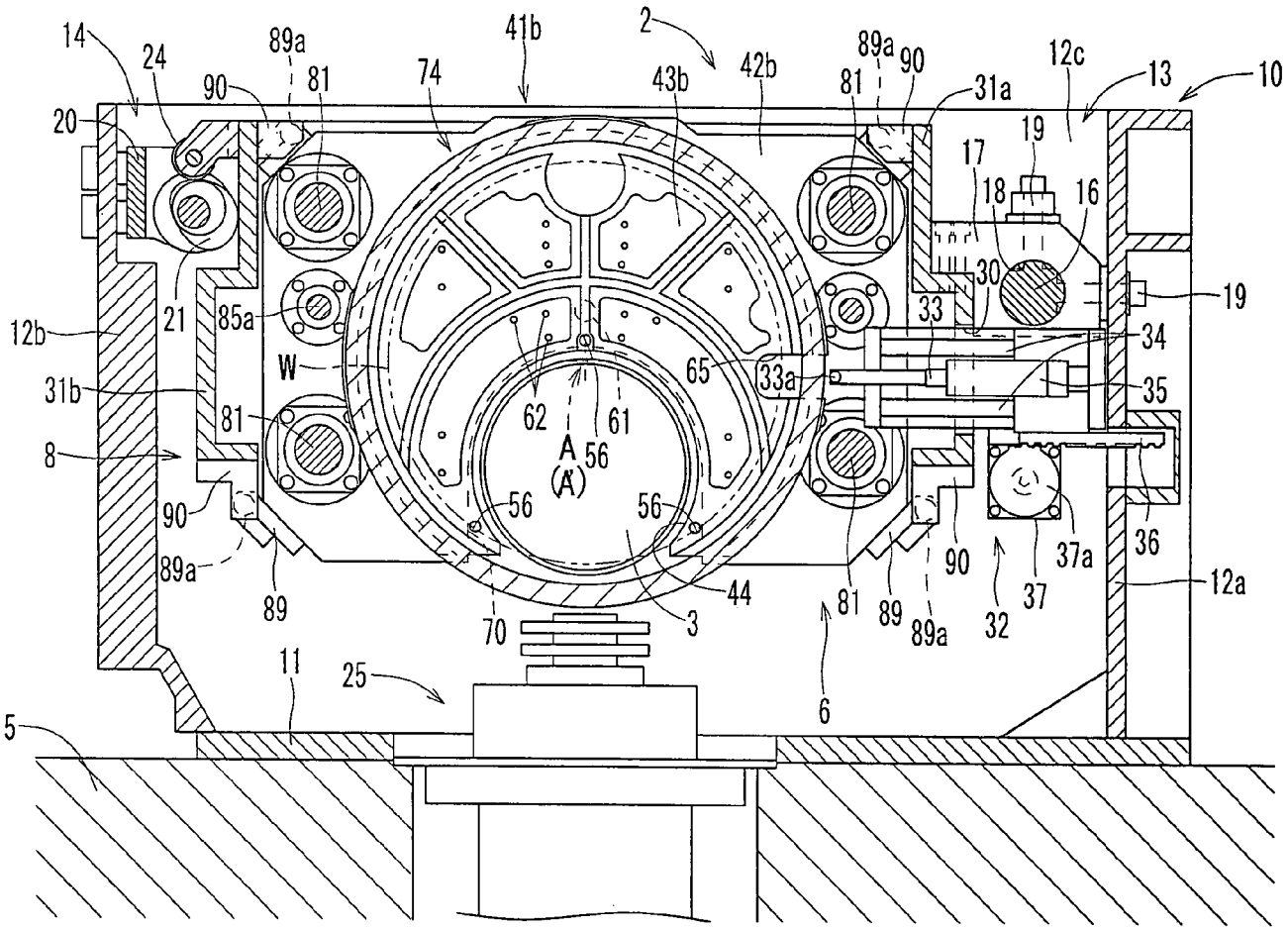

[Fig. 8]
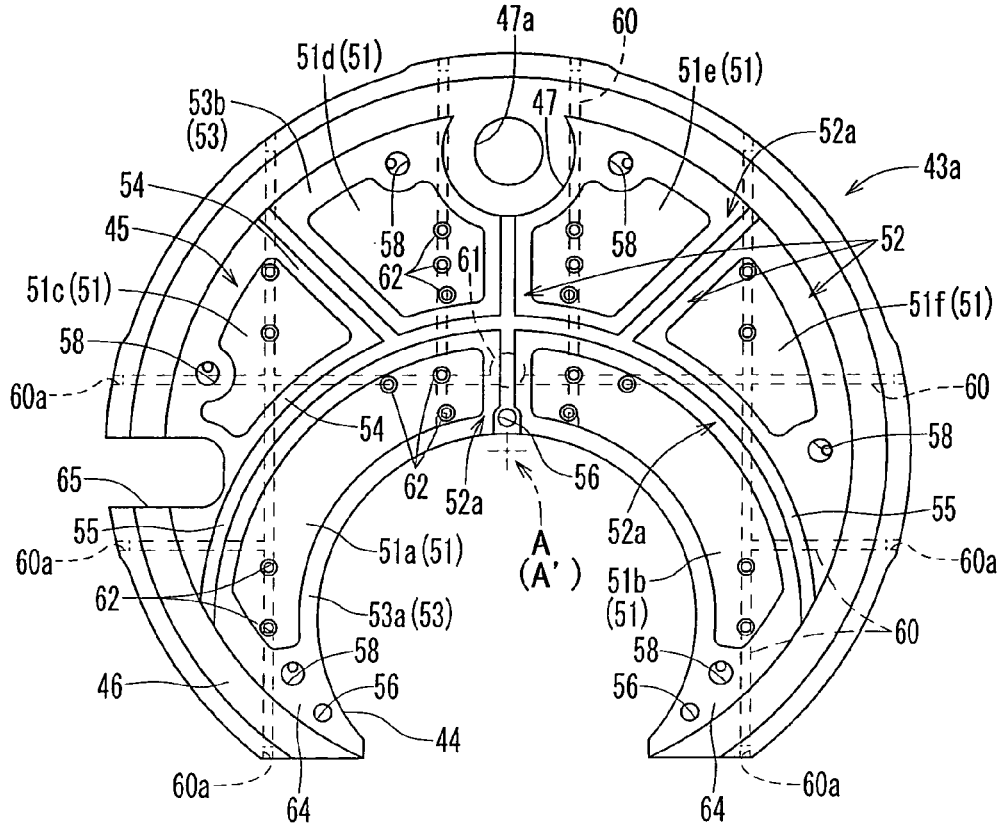
[Fig. 9]
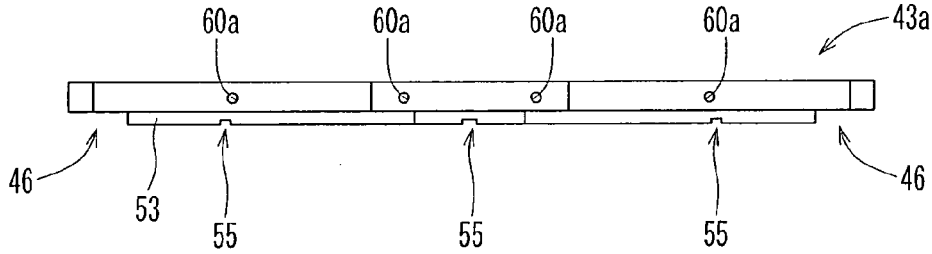
[Fig. 10]
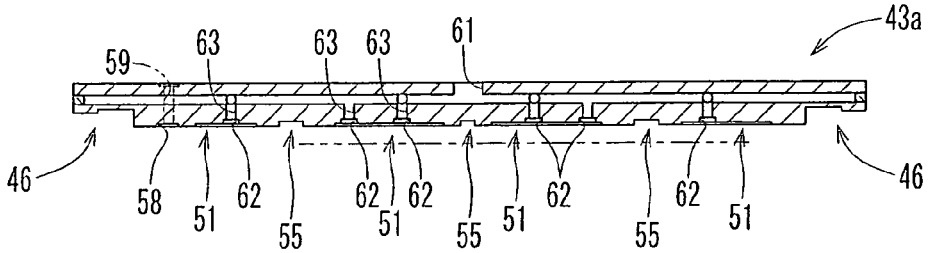

[Fig. 11]
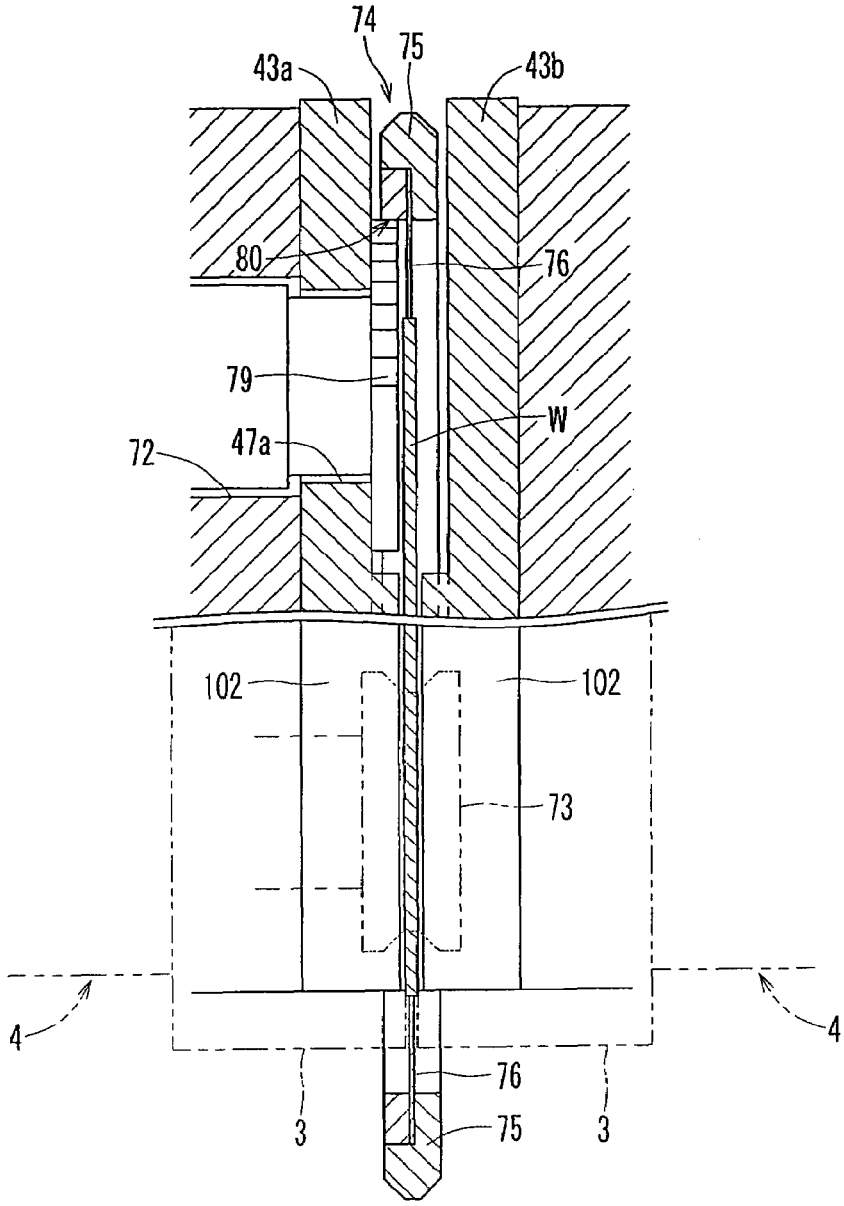

[Fig. 12]
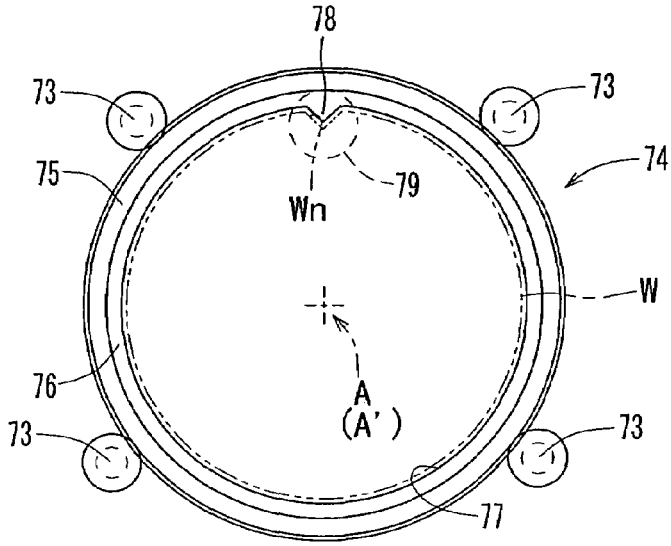
[Fig. 13]
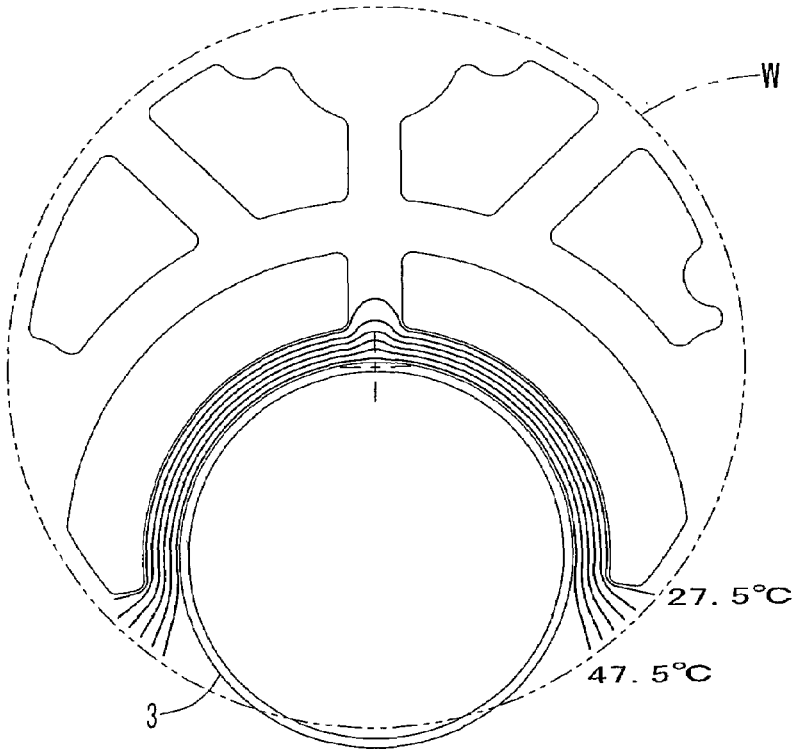

[Fig. 14]
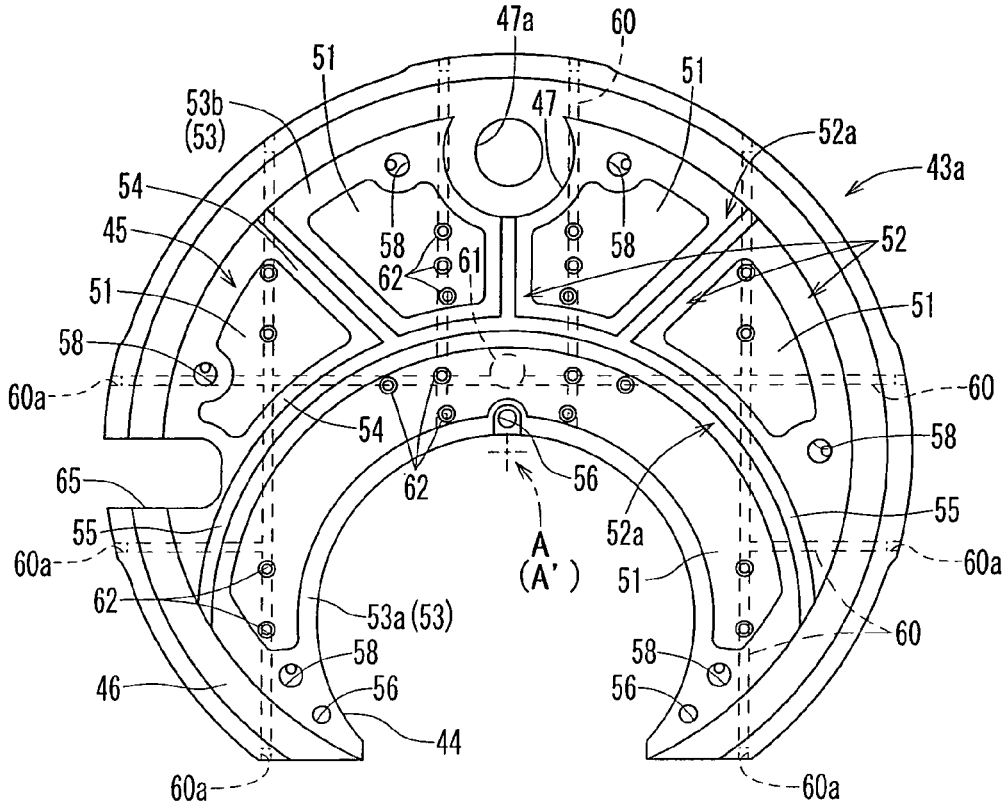

[Fig. 15] PRIOR ART
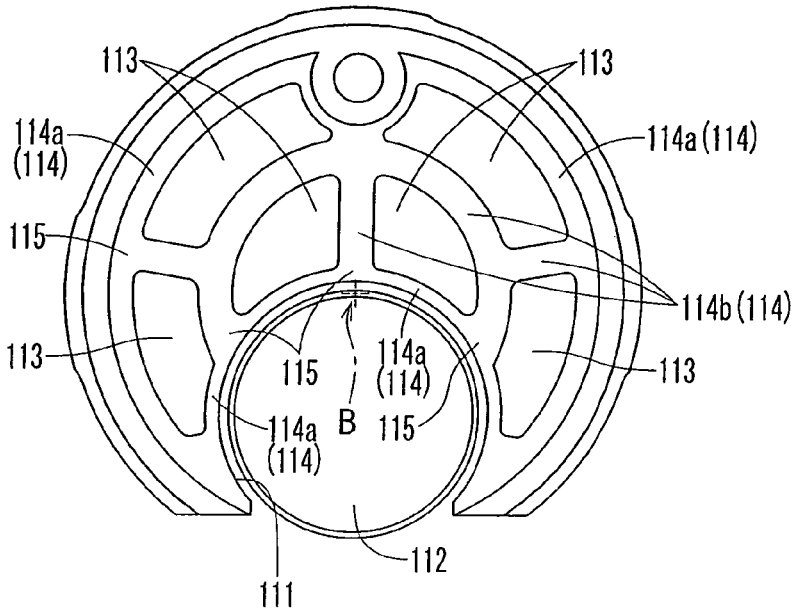
[Fig. 16]
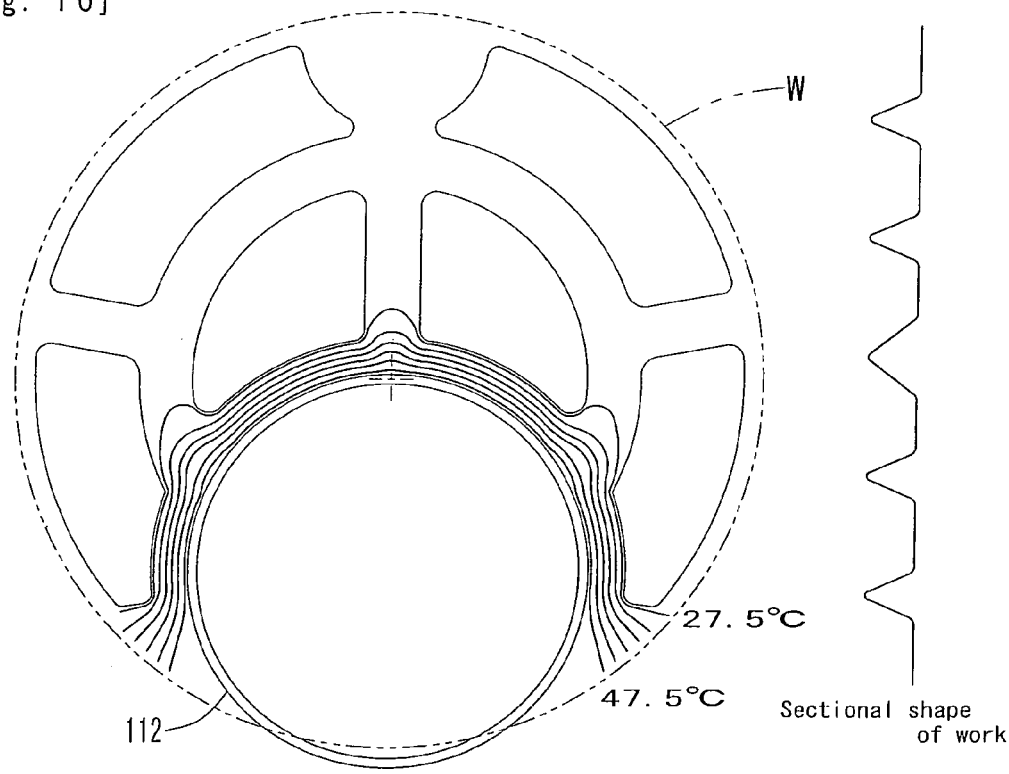

TWO-SIDED SURFACE GRINDING APPARATUS

BACKGROUND OF THE INVENTION

The present invention relates to a two-sided surface grinding apparatus for grinding the opposite surfaces of thin sheet-like work, such as a semiconductor wafer.

As for a two-sided surface grinding apparatus for grinding the opposite surfaces of thin sheet-like work, such as a semiconductor wafer, there is a known one described, for example, in Japanese Patent Laid Open No. 2000-280155 gazette. The two-sided surface grinding apparatus described in Japanese Patent Laid Open No. 2000-280155 gazette comprises a pair of grinding whetstones rotatably supported with their grinding surfaces opposed to each other, a work rotation support means for supporting thin sheet-like work for rotation around the axis of a rotary shaft parallel with the rotary shaft of the grinding whetstones in such a state that at least part of each of the grinding subject surfaces on the opposite surfaces is disposed in the grinding position between the grinding surfaces of the grinding whetstones, and a pair of noncontact support means disposed in such a manner as to hold therebetween from opposite sides substantially the entire surface of a region outwardly of the grinding position in the grinding subject surfaces of the work and in such a manner as to noncontactly support the work by the pressure of a fluid, wherein the grinding subject surfaces on the opposite surfaces of the work are ground by rotating the work and the grinding whetstones with the work supported by the noncontact support means.

Further, in this two-sided surface grinding apparatus, the diameter of the grinding surfaces of the grinding whetstones is substantially equal to or somewhat greater than the radius of the work. That is, the relative positional relation between the grinding whetstones and the work is set such that the grinding surfaces of the grinding whetstones are always applied to the center of the grinding subject surfaces and part of the outer periphery of the work, thereby enabling the grinding whetstones to uniformly grind the entire surface of the work.

The noncontact support surfaces of the noncontact support means in this kind of two-sided surface grinding apparatus have been generally, for example, in the shape shown in FIG. 15. That is, an arcuate notch 111 is formed which extends from the substantially circular outer edge thereof at least over the central position B of work, with a grinding whetstone 112 disposed in this notch 111. Further, disposed in the noncontact support surfaces are a plurality of pockets 113 formed as recesses of substantially uniform depth, the arrangement being such that fluid, such as water, is discharged from fluid supply holes (illustration omitted) formed in the inner walls of these pockets 113.

Further, the pockets 113 are radially disposed in a plurality of rows (two rows in this case) so that they are substantially concentric circles with respect to the work center B. That is, a netlike mesh section 114 forming banks around the peripheries of the pockets 113 is composed of peripheral edges 114*a* disposed along the outer periphery of the noncontact support surfaces, and inside veins 114*b* disposed so as to divide the region inwardly of the peripheral edges 114*a* into a plurality of sections and connected to the peripheral edges 114*a* in a plurality of inside-and-outside connecting sections 115.

In the case of grinding the opposite surface of a wafer (for example, having a diameter of about 300 mm) by using a conventional two-sided surface grinding apparatus mentioned above, the wafer surfaces after grinding, as is known, have produced undulations of not more than μm order in concentric circles (hereinafter referred to simply as undulations) outwardly of the surfaces; however, such slight amount of undulations has heretofore caused no particular problem.

However, in recent years micronization of patterns to be formed on wafer surfaces has advanced, followed by the focal depth of exposure devices becoming very shallow, thus demanding a higher level for the flatness of the wafer surfaces, thus bringing about a situation in which even the undulations of not more than μm mentioned above can no longer be ignored.

With such conventional problems in mind, the present invention has for its object the provision of a two-sided surface grinding apparatus capable of eliminating the undulations of concentric circles produced on the work surface by grinding, thereby further improving the flatness of the work surfaces after grinding.

SUMMARY OF THE INVENTION

With the conventional two-sided surface grinding apparatus having the noncontact support surfaces shown in FIG. 15 used as a subject, a temperature analysis for the noncontact support surfaces has been conducted, and it has been found that as shown in FIG. 16, a plurality of places (5 places) where the temperature distribution is disturbed exist along the outer periphery of the grinding whetstone 112 where the temperature is highest (the outer periphery of the notch 111). The place where the temperature distribution is disturbed coincides with the inside-and-outside connecting sections (the connecting portion between the inside vein 114*b* and the peripheral edge 114*a*) 115, etc., existing along the periphery of the notch 111 and also substantially coincides with a place of undulations produced on the surfaces of the wafer W after grinding.

From this it is inferred that the disturbance of the temperature distribution in the periphery of the notch 111 is one factor in the production of undulations on the wafer surface after grinding. It is believed that by disposing the pockets 113 and a mesh section 114 in such a manner as to minimize the number of inside-and-outside connecting sections 115 existing in the periphery of the notch 111, the disturbance of the temperature distribution in the periphery of the notch 111 can be minimized and by the same token, the undulations of concentric circles produced on the work surface due to grinding can be suppressed.

Accordingly, the invention provides a two-sided surface grinding apparatus comprising a pair of grinding whetstones rotatably supported with their grinding surfaces opposed to each other, a work rotation support means for supporting thin sheet-like work for rotation around a rotation axis parallel with the rotary shafts of said grinding whetstones in such a manner that at least parts of the grinding subject surfaces on the opposite surfaces are disposed in a grinding position between said grinding surfaces, and a pair of noncontact support means which are disposed so as to hold substantially the entire surface of a region outwardly of said grinding position and which noncontactly support said work by fluid pressure, the grinding subject surfaces on the opposite surfaces of said work being ground by rotating both said work and said grinding whetstones with said work supported by said noncontact support means, said two-sided surface grinding apparatus being characterized in that said noncontact support means are formed with substantially arcuate notches corresponding to said grinding whetstones at least over the central position of said work from their substantially circular outer edges, while the noncontact support surfaces opposed to said work are provided with a plurality of pockets recessed therein and provided with a single or a plurality of fluid supply holes in the inner wall thereof for discharging said fluid and are also provided with a netlike mesh section forming banks around the peripheries of these pockets, said mesh section being composed of peripheral edges disposed along the outer peripheries of the noncontact support surfaces, and inside veins disposed so as to divide the region inwardly of the peripheral edges into a plurality of sections and connected to the peripheral edges in a plurality of inside-and-outside connecting sections, the portion of said peripheral edge which extends along said notches not being provided with any inside-and-outside connecting section at least in the region excluding the vicinity of the central position of the work.

According to the invention, the positions of the inside-and-outside connecting sections existing along the periphery of the notch in the noncontact support means can be regarded as being at least in the vicinity of the central position of the work, thereby making it possible to regard the place of disturbance of temperature distribution in the periphery of the notch as being only the position corresponding to the vicinity of the periphery of the work W or as being only the position corresponding to the vicinity of the outer periphery of the work W and to its central section. This makes it possible to effectively prevent the formation of undulations of concentric circles produced in the work, which has been a problem with the conventional two-sided surface grinding apparatus, thus making it possible to further improve the flatness of the work surfaces after grinding.

Further, by disposing the fluid supply holes in the pockets provided along the notch, in the vicinity of the inside-and-outside connecting sections and in the vicinity of the connecting section between the inner peripheral edge provided along the notch and the outer peripheral edge other than the same, the fluid supplied from the fluid supply holes passes first in the vicinity including the inside-and-outside connecting sections, so that the vicinity including the inside-and-outside connecting sections can be effectively cooled; thus, the undulations of concentric circles produced in the work after grinding can be further suppressed.

Further, by forming the pocket provided along the notch such that they are substantially equal radially in width along the peripheral direction of the grinding whetstones, the thermal conduction characteristics around the periphery of the notch can be made substantially constant along the notch, thereby further suppressing the undulations of concentric circles having been produced in the work after grinding.

BRIEF DESCRIPTION OF THE DRAWINGS

FIG. 1 is a plan view of a two-sided surface grinding apparatus, showing a first embodiment of the invention.

FIG. 2 is a front view of the two-sided surface grinding apparatus, showing the first embodiment of the invention.

FIG. 3 is a sectional front view of the two-sided surface grinding apparatus, showing the first embodiment of the invention.

FIG. 4 is a sectional front view of the two-sided surface grinding apparatus, showing the first embodiment of the invention.

FIG. 5 is an explanatory view of a work mounting process, showing the first embodiment of the invention.

FIG. 6 is a sectional side view, seen rightward, of the two-sided surface grinding apparatus, showing the first embodiment of the invention.

FIG. 7 is a sectional side view, seen leftward, of the two-sided surface grinding apparatus, showing the first embodiment of the invention.

FIG. 8 is a side view of support pads, showing the first embodiment of the invention.

FIG. 9 is a plan view of the support pads, showing the first embodiment of the invention.

FIG. 10 is a cross-sectional view of the support pads, showing the first embodiment of the invention.

FIG. 11 is a principal enlarged sectional view of the two-sided surface grinding apparatus, showing the first embodiment of the invention.

FIG. 12 is a side view of a work holding carrier, showing the first embodiment of the invention.

FIG. 13 is a view showing the results of temperature analysis using the support pads, showing the first embodiment of the invention.

FIG. 14 is a side view of the support pads, showing a second embodiment of the invention.

FIG. 15 is a side view of the noncontact support surfaces of a noncontact support means according to the prior art.

FIG. 16 is a view showing the results of temperature analysis using the noncontact support means according to the prior art.

DETAILED DESCRIPTION OF THE INVENTION

Embodiments of the invention will now be described in detail with reference to the drawings. FIGS. 1-13 show by way of example a first embodiment of the invention. In addition, in the following description, when the words front, rear, left and right are used, this should be understood to mean that in FIG. 1, the lower side is front, the upper side is rear, and left and right is left and right.

In FIGS. 1-7, the numeral 1 denotes a two-sided surface grinding apparatus which comprises a work drive device 2 for holding and rotationally driving thin sheet disk-like work W, such as a semiconductor wafer, and whetstone devices 4 having grinding whetstones 3 for grinding the opposite surfaces of the work W held and rotated by said work drive device 2. Such work drive device 2 and whetstone devices 4 are removably fixed on a horizontal bed 5.

The work drive device 2, which is used for holding and rotationally driving the work W when the opposite surfaces of the work W are to be ground, comprises a work holding means 6 for holding the work W from its peripheral edge and from its opposite surfaces, a work drive mechanism 7 for rotationally driving the work W held by said work holding mean 6, an inner case 8 for movably supporting the work holding means 6 and covering the periphery thereof, and slide drive mechanisms 9 for slide-wise moving the work holding means 6 with respect to the inner case 8, and an outer case 10 for supporting the inner case 8 and covering its outside.

The outer case 10 is shaped like a substantially rectangular box opened at the top, using a base 11 substantially horizontally fixed to the upper surface of the bed 5, and front, rear, left-hand and right-hand side wall plates 12*a*-12*d*. The outer case 10 is provided at its front with a front support means 13 for supporting the front side of the inner case 8 and at its rear with a rear support means 14 for supporting the rear of the inner case 8.

The front support means 13, which is used for swingably supporting the inner case 8 at its front, comprises a pair of bearings 15*a* and 15*b* disposed in the front upper regions of the left-hand and right-hand side wall plates 12*c* and 12*d*, respectively, and a support rod 16 horizontally carried between the left-hand and right-hand side wall plates 12*c* and 12*d* and rotatably supported at opposite ends for rotation by bearings 15*a* and 15*b*. This support rod 16 is inserted in through-holes 18 in support brackets 17 disposed in the front left-hand and right-hand regions of the inner case 8 and is fixed to the support brackets 17 by fixing bolts 19. That is, the inner case 8 is swingably supported by the support rod 16 through the support brackets 17 disposed on the front side of the inner case 8.

The rear support means 14, which is used for supporting the inner case 8 at its rear for height adjustment, comprises a cam 21 supported for rotation around a left-right direction axis by a bracket 20 disposed in the front upper region of the rear side wall plate 12*b*, and a drive motor 23 removably disposed, for example, on the outside of the left-hand side wall plate 12*c* to rotationally drive the cam 21 through a drive shaft 22, with the cam 21 having placed thereon a support roller 24 disposed on the rear side of the inner case 8. Actuating the drive motor 23 rotates the cam 21 through the drive shaft 22, vertically moving the position of the support roller 24 placed on the cam 21. That is, the inner case 8 is supported for height adjustment by the cam 21 in the outer case 10 through the support roller 24 at its rear.

Further, disposed inside the outer case 10 at the bottom is a dressing device 25 for dressing the grinding whetstones 3. This dressing device 25 is removably fixed, for example, on the bed 5.

The inner case 8 is shaped like a substantially rectangular box opened at the top and bottom, using front, rear, left-hand and right-hand side wall plates 31*a*-31*d* and is disposed, for example, inside the outer case 10 on its upper side. The support brackets 17 fixed to the front left-hand and right-hand regions of the front side wall plate 31*a*, while the support roller 24 supported for rotation around a left-right direction axis in the rear upper region of the rear side wall plate 31*b*.

Further, the front side wall plate 31*a* is formed with an opening 30 in the front-rear direction, and a plate thickness measuring means 32 is disposed for front-rear movement in said opening 30. This plate thickness measuring means 32, which is used for measuring the plate thickness after the grinding of the work W, comprises a pair of measuring arms 33 mounted, for example, on a support plate 42*a* to be later described and formed in a rod shape extending in the front-rear direction, with a measuring end 33*a* installed at the front end (rear end), guide rails 34 disposed on the upper and lower sides of each of these measuring arms 33 and extending in the front-rear direction, main bodies 35 each supporting the measuring arms 33 at their front ends and supported for slide movement in the front-rear direction by the guide rails 34, racks 36 extending in the front-rear direction and each fixed to the main body 35, and drive motors 37 each disposed in the vicinity of the main body 35, for example, on the lower side thereof and rotationally driving a pinion 37*a* meshing with the rack 36, thereby moving the main body 35 along the guide rails 34 in the front-rear direction.

The work holding means 6 is composed of left-hand and right-hand work holding bodies 41*a* and 41*b* opposed to each other and supported for movement in the left-right direction by the inner case 8. These work holding bodies 41*a* and 41*b* are respectively provided with a pair of support plates 42*a* and 42*b* disposed in parallel with the vertical plane in the front-rear direction, and a pair of support pads (noncontact support means) 43*a* and 43*b* disposed on opposite sides of these support plates 42*a* and 42*b*.

The support pads 43*a* and 43*b*, which are used for noncontactly support the work W from opposite sides by the pressure of fluid, such as water, are formed substantially in a circular plate shape, and, for example, their lower sides are upwardly formed with whetstone-associated notches 44 arcuate in shape corresponding to the grinding whetstones 3, extending to a position somewhat over the central position A of said support pads 43*a* and 43*b*.

FIGS. 8-10 show the support pad 43*a* on the left hand work support body 41*a*. In addition, the support pad 43*b* of the right-hand work support body 41*b* is substantially equal in shape to this support pad 43*a*, so that an enlarged view of the support 43*b* is omitted and those differ therefrom will be described whenever there is such difference.

The opposed surfaces of the support pads 43*a* and 43*b* are formed with steps 46 of predetermined width one step lower than the inner noncontact support surfaces 45, along the outer edge excluding the whetstone-associated notches 44. Further, in a predetermined position on the level difference section 46, for example, in the uppermost position, there is formed a recess 47 arcuately recessed toward the central position A. Further, in the case of the support pad 43*a* of the left-hand work support body 41*a*, the recess 47 is formed with a through-hole 47*a* concentric with the recess 47, at the center of the recess 47, in the direction of the plate thickness (left-right direction). The support pads 43*b* are each formed with the recess 47 alone, not being formed with the through-hole 47*a*.

The noncontact support surfaces 45 of the support pads 43*a* and 43*b*, that is, the portions inwardly of the level difference sections 46 on the opposed surface, are each formed with a plurality of pockets 51 recessed in the direction of the plate thickness, and other portion than the pockets 51 is in the form of a netlike mesh section 52 forming the banks of the pockets 51.

The mesh section 52 is composed of a peripheral edge 53 disposed along the outer periphery of the noncontact support surface 45, and an inside vein 54 disposed so as to divide the region of the inside of the peripheral edge 53 into a plurality of sections and connected to the peripheral edge 53 at the plurality of inside-and-outside connecting sections 52*a*. Further, the peripheral edge 53 is composed of an inner peripheral edge 53*a* disposed along the whetstone-associated notches 44, and an outer peripheral edge 53*b* other than the same, and these inner and outer peripheral edges 53*a* and 53*b* are connected together at the opposite ends of the whetstone-associated notches 44.

The inside veins 54 are formed with grooves 55 of predetermined width to extend through substantially the widthwise center. The grooves 55, which function as discharge passages for fluid discharged from the fluid supply holes 62 to be later described into the pocket 51, cross each other or branch at the crossings or branches of the inside veins 54, with their ends extending across the peripheral edges 53 to communicate with the level difference sections 46 or whetstone-associated notches 44. In addition, the depth of the grooves 55 is less than that of the level difference sections 46.

At predetermined positions on the inner peripheral edge 53, for example, at three places, that is, the vicinities of opposite ends of the whetstone-associated notches 44 and the vicinity of the central position A, there are formed distance detecting sensor holes 56 for detecting the distance to the work W by air pressure. The distance detecting sensor holes 56 are connected, for example, to a fluid supply source through communication passages (illustration omitted) in the support pads 43*a* and 43*b*, the arrangement being such that predetermined distance detecting means (illustration omitted) detect the distances between the support pads 43*a*, 43*b* and the work W, respectively, on the basis of the air pressure from the fluid supply source. Further, in the case of the support pad 43*a* of the left-hand work support body 41*a*, seating detection sensor holes 58 are formed in predetermined positions on the peripheral edge 53, for example, at a total of six places, that is, the vicinities of the uppermost position on the outer peripheral edge 53*b* (the vicinities of opposite sides of the recess 47), and central positions in the vertical direction. The seating detection sensor holes 58 are connected, for example, to a negative pressure source through communication passages 59 in the support pads 43*a*, the arrangement being such that predetermined seating detecting means (illustration omitted) detect the presence or absence of the seating of the work W on the basis of variations of the load in the negative pressure source.

In addition, in order to secure a fixed width around the peripheries of the sensor holes 56 and 58, the peripheral edge 53 is so formed as to be wide in the inner pockets 51 in the vicinities of these sensor holes 56 and 58. In addition, the support pad 43*b* of the right-hand work support body 41*b* is not formed with the seating detection sensor holes 58, but the mesh section 52 is formed substantially equal in shape to the support pad 43*a*.

Further, the noncontact support surfaces 45 are divided in a netlike manner by said mesh section 52; therefore, in this embodiment, the support pads 43*a* and 43*b* each have six pockets 51 which are so disposed as to be substantially symmetrical with respect to the vertical axis passing through the central position A. Of these six pockets 51, two pockets 51*a* and 51*b* are disposed adjacent to each other along the whetstone-associated notches 44, with the inside-and-outside connecting sections 52*a* disposed between these two pockets 51*a* and 51*b*. That is, in the case of the support pads 43*a* and 43*b* in this embodiment, the inside-and-outside connecting section 52*a* which is provided on the inner peripheral edge 53*a* at only one place in the vicinity of the central position A, not provided in any position other than the same on the inner peripheral edge 53*a*.

Further, the two pockets 51*a* and 51*b* disposed along the whetstone-associated notches 44 are so formed as to be substantially equal in radial width along the peripheral direction of the whetstone-associated notches 44, that is, along the peripheral direction of the grinding whetstones 3. Further, the remaining four pockets 51*c*-51*f* are formed so that their remaining regions are divided by the portion of the inside vein 54 which is disposed radially of the work W; thus, they are substantially equal in area.

Fluid passages 60 are disposed in the surfaces the support pads 43*a* and 43*b* longitudinally and transversely, singly or plurally, respectively. These fluid passages 60 cross each other to thereby communicate with each other. At the back sides of the support pads 43*a* and 43*b* (the reverse sides of the opposed surfaces), a fluid supply port 61 communicating with the fluid passages 60 is formed in a predetermined position corresponding to the mesh section 52, for example, above the central position A in such a manner that it recesses to the opposed sides. In addition, the outer peripheral ends 60*a* of the fluid passages 60 are all closed with plugs.

The inner wall of each pocket 51 is formed with a single or a plurality of fluid supply holes 62 for discharging fluid. These fluid supply holes 62 are all formed in positions along the fluid passages 60 and communicate with the fluid passages 60, respectively, through connecting passages 63 formed in the direction of the plate thickness of the support pads 43*a* and 43*b*.

The two pockets 51*a* and 51*b* disposed along the whetstone-associated notches 44 are each provided with a plurality of, for example, five fluid supply holes 62. These plurality of fluid supply holes 62 are disposed concentratedly in the vicinity of the inside-and-outside connecting sections 52*a* and in the vicinity of the connecting section 64 between the inner and outer peripheral edges 53*a* and 53*b*.

Further, the support pads 43*a* and 43*b* are formed with plate thickness sensor notches 65 of predetermined depth directed from predetermined positions on the outer periphery excluding the whetstone-associated notches 44, for example, from substantially the vertical central position on the rear side to the inner side (the center side), for example, in the horizontal direction.

The support plates 42*a* and 42*b* are formed substantially in rectangular form which is substantially equal in vertical dimension to the support pads 43*a* and 43*b* and which is greater in front-rear dimension than the support pads 43*a* and 43*b*, with the support pads 43*a* and 43*b* are, for example, removably fixed substantially in the central position on the opposed surface side. Further, the support plates 42*a* and 42*b* are formed with notches 70 corresponding to whetstone-associated notches 44 in the support pads 43*a* and 43*b*, and are also formed with fluid passages 71 communicating with the fluid supply port 61 in the support pad 43*a* and 43*b* and connected to a fluid supply means (illustration omitted). Further, the support plate 42*a* of the left-hand work support body 41*a* is formed with a through-hole 72 corresponding to the through-hole 47*a* in the support pad 43*a*.

The support plate 42*a* of the left-hand work support body 41*a* has four support rollers 73 disposed on the periphery of the support pad 43*a* on the side opposed to the right-hand work support body 41*b* with substantially equal pitch, for example, along the outer periphery of the support pad 43*a*, and a work holding carrier (work rotation support means) 74 for supporting the work W is rotatably supported by these four support rollers 73.

The work holding carrier 74, as shown in FIGS. 11 and 12, is composed of a thick-walled ring 75, and a thin sheet-like holding plate 76 projecting from the ring 75 radially inward by a predetermined dimension. The inner periphery of the holding plate 76 provides a work fitting section 77 allowing the work W to be fitted therein, and a projection 78 formed on part of its inner periphery to be directed radially inward is adapted to mesh with a notch Wn in the work W. In addition, the plate thickness of the holding plate 76 is so formed as to be smaller than that of the work W.

Further, the work holding carrier 74 has its ring 75 so formed as to correspond in dimension to the level difference section 46 of the support pad 43*a* and 43*b*. Further, the inner diameter of the holding plate 76 is so formed as to be somewhat smaller than the outer diameter of the noncontact support surface 45 and is supported by the support rollers 73 so that its center substantially coincides with the central position A in the support pad 43*a* and 43*b* in the direction of the surfaces of the support pads 43*a* and 43*b*. Thereby, the work W held by the work holding carrier 74 has its outer edge positioned on the outer peripheral edge 53*b* of the support pads 43*a* and 43*b*. The central position of the work W is hereinafter denoted by the character A' in distinction from the central position A in the support pads 43*a* and 43*b*.

Further, the inner periphery of the ring 75 is formed with an internal gear 80 meshing with a work drive gear 79 disposed in the recess 47 on the support pad 43*a* side, it being arranged that the driving of the work drive mechanism 7 including this work drive gear 79 causes the work W to rotate through the work holding carrier 74. The work holding bodies 41*a* and 41*b* are supported for left-right slide movement by a plurality of (for example, four) guide rods 81 disposed left and right on the inner case 8 side. That is, on the inner case 8 side, a total of four guide rods 81, one front, one rear, one top, one bottom, are installed between the left-hand and right-hand side wall plates 31*c* and 31*d*. Further, the work holding bodies 41*a* and 41*b* are provided with four through-holes 82 corresponding to the guide rods 81, in positions on the work holding bodies 41*a* and 41*b* and on opposite sides, left and right, of the support pads 43*a* and 43*b*. The work holding bodies 41*a* and 41*b* are supported for left-right slide movement by fitting the through-holes 82 on the guide rods 81 in the inner case 8 through slide sleeves 83.

In addition, the guide rods 81 are covered by flexible covers 81*a* between the work holding bodies 41*a*, 41*b* and the inner case 8.

Further, the work holding bodies 41*a* and 41*b* are adapted to be slidably driven along the guide rods 81 by the slide drive mechanisms 9. The slide drive mechanisms 9, as shown in FIG. 4, etc., are disposed on opposite sides, left and right, of the work holding bodies 41*a* and 41*b*, correspondingly between the upper and lower guide rods 81, 81, and each is composed of a first cylinder 84, such as of the air pressure type, which has its cylinder main body fixed to the support plate 42*b* of the right-hand work holding body 41*b* with the drive shaft 84*a* directed to the left-hand work holding body 41*a*, and which has a drive shaft 84*a* fixed to the left-hand work holding body 41*a* side, and a second cylinder 85, such as of the air pressure type, having a cylinder main body fixed to the left-hand side wall plate 31*c* of the inner case 8 and a drive shaft 85*a* directed to the right-hand work holding body 41*b* and fixed to the left-hand work holding body 41*a*.

The first cylinder 84 has its cylinder main body fixed to the right-hand side of the support plate 42*b* of the right-hand work holding body 41*b*, and the drive shaft 84*a* slidably extends through a guide hole 86 formed in the support plate 42*b* is fixed to the left-hand work holding body 41*a*. The second cylinder 85 has its cylinder main body fixed to the left-hand surface of the left-hand wall plate 31*c* of the inner case 8, and the drive shaft 85*a* slidably extends through a guide hole 87 formed in the left-hand wall plate 31*c* and is fixed to the support plate 42*a* on the left-hand work holding body 41*a* side.

These slide drive mechanisms 9 hold, during the grinding of the work W, the work holding bodies 41*a* and 41*b* in the "grinding position" (see FIGS. 1 through 3) where the support pads 43*a* and 43*b* are close to each other substantially in the left-right central position in the inner case 8. In this "grinding position," the abutment sections 89*a* of positioning means 89 disposed at least one place on each of the work holding bodies 41*a* and 41*b*, for example, at four corners, abut against stops 90 in the inner case 8 and are thereby accurately positioned. In addition, the abutment section 89*a* is composed of an adjustable bolt or the like capable of adjusting the amount of its projection.

At the time of mounting and dismounting of the work W, the first cylinder 84 alone is actuated in a direction to project the drive shaft 84*a* from the state in which the work holding bodies 41*a* and 41*b* are in the "grinding position," and the right-hand work holding body 41*b* is held in the "work mounting and dismounting position" (see FIG. 5) spaced a predetermined distance from the left-hand work holding body 41*a*. Further, when the dressing device 25 is to perform dressing with the grinding whetstones 3, the first cylinder 84 is actuated in a direction (leftward direction) to project the drive shaft 84*a*, for example, from a state in which the work holding bodies 41*a* and 41*b* are in the "grinding position," and the second cylinder 85 is actuated in a direction (leftward direction) to retract the drive shaft 85*a*, whereby the left-hand and right-hand work holding bodies 41*a* and 41*b* are moved to be spaced away from each other so as to be held in the "dressing-time position" (see FIG. 4).

In addition, the drive shaft 85*a* is covered by a flexible cover 91 between the left-hand side wall plate 31*c* of the inner case 8 and the left-hand work holding body 41*a*. Further, the right-hand end of the cylinder main body of the first cylinder 84 projects outside the outer case 10 through an opening 92 formed in the right-hand side wall plate 12*d* of the outer case 10, and at least part of the side surface of the projecting section is covered by a flexible cover 93. Further, the left-hand end of the cylinder main body of the second cylinder 85 projects outside the outer case 10 through an opening 94 formed in the left-hand side wall plate 12*c* of the outer case 10, and at least part of the side surface of the projecting section is covered by a flexible cover 95.

The work drive mechanism 7, as shown in FIG. 3, etc., is provided with a work drive gear 79 disposed on the left-hand work support body 41*a* side, and a work drive motor 97 fixed to the inner case 8 and adapted to rotationally drive the work drive gear 79.

The work drive gear 79 is rotatably disposed in the recess 47 in the state in which its rotary shaft 79*a* is inserted from the through-hole 47*a* in the support pad 43*a* into the through-hole 72 in the support plate 42*a*. Connected to the left-hand end of the rotary shaft 79*a* of this work drive gear 79 is a connecting shaft 98 formed with an axial groove 98*a*, for example.

The work drive motor 97 removably fixed to the outside of the right-hand side wall plate 31*c* of the inner case 8 through an open hole 99 in the outer case 10. The work drive motor 97 has a drive connecting section 100 to which the rotation of its drive shaft 97*a* is transmitted, and which is disposed eccentrically with respect to the drive shaft 97*a*. This drive connecting section 100 is formed with a left-right through-hole formed at its center with a projection (illustration omitted) corresponding to the groove 98*a* in the connecting shaft 98, and the connecting shaft 98 of the left-hand work support body 41*a* extends through this through-hole for left-right slide movement via a through-hole 101 in the left-hand side wall plate 31 of the inner case 8.

This ensures that although the left-hand work support body 41*a* is capable of left-right movement with respect to the inner case 8, the drive force from the work drive motor 97 in the inner case 8 is transmitted to the work drive gear 79 through the drive shaft 97*a*, drive connecting section 100 and connecting shaft 98.

In addition, the flexible cover 96 for covering the connecting shaft 98 is mounted between the left-hand side wall plate 31*c* of the inner case 8 and the left-hand work holding body 41*a*.

The whetstone devices 4 each comprise a grinding whetstone 3, which is, for example, cup-shaped, and a drive motors (illustration omitted) for rotationally driving the grinding whetstone 3, these components being disposed, left and right, on opposite sides of the work drive device 2, one on each side. The whetstone devices 4 have their grinding whetstones 3 disposed so as to be opposed to the opposite surfaces of the work W held by the work holding carrier 74, successively through open holes 102 formed in the outer case 10 of the work drive device 2, notches 103 formed in the inner case 8, notches 70 in the work holding bodies 41*a* and 41*b*, and whetstone-associated notches 44.

In addition, the whetstone devices 4 are adapted to move the grinding whetstones 3 axially (in the left-right direction) and are arranged to move the grinding whetstones 3 from the "grinding position" to a predetermined "waiting position" at the time of mounting and dismounting of the work W.

In the two-sided surface grinding apparatus 1 having the above arrangement, when the grinding of the work W is to be performed, the grinding whetstones 3 are held in the "waiting position" and the work holding bodies 41*a* and 41*b* are held in the "work mounting and dismounting position," in which state the work W is mounted in the work fitting section 77 of the work holding carrier 74 via the work holding bodies 41*a* and 41*b* by an unillustrated loader (see FIG. 5). At this time, the projection 78 on the work fitting section 77 engages the notch Wn in the work W, with the work W substantially abutting against the noncontact support surface 45 of the support pad 43*a* (see FIGS. 11 and 12).

When the work W is mounted in the work fitting section 77 of the work holding carrier 74, the seating detection sensor holes 58 in the support pad 43*a* are substantially closed by the work W, so that the seating of the work W is detected by the seating detection means on the basis of variations in the load in the negative pressure source connected to the seating detection sensor holes 58.

When the seating of the work W is detected, the first cylinder 84 is actuated in a direction to retract the drive shaft 84*a*, so that the right-hand work holding body 41*a* is moved to the left-hand work holding body 41*a* and the support pads 43*a* and 43*b* are held in the "work mounting and dismounting position" close to the opposite surfaces of the work W. And, fluid such as air or water is spouted from the fluid supply holes 62 of the pockets 51 successively through the fluid supply means (illustration omitted), fluid passages 71 in the support plates 42*a* and 42*b*, fluid supply ports 61 of the support pads 43*a* and 43*b*, fluid passages 59, and connecting passages 63, while the work W is held in a noncontact state by being subjected to the pressure of this fluid from its opposite surfaces in a region outwardly of the position for grinding by the grinding whetstones 3.

In this state, the work drive motor 97 is driven to cause the work holding carrier 74 to start to rotate through the work drive gear 79, whereby the work W also starts to rotate, and the left-hand and right-hand grinding whetstones 3 also start to rotate. When the work W starts to rotate, the left-hand and right-hand grinding whetstones 3 start to rotate and gradually move from the "waiting position" so as to be close to the grinding subject surfaces of the work W. Ultimately the work W is held between the left-hand and right-hand grinding whetstones 3 from opposite sides; thus, the grinding of the work W is started.

During the grinding by the grinding whetstones 3, if, for example, a difference in the amount of wear occurs between the left-hand and right-hand grinding whetstones 3, resulting in a left-right shift between the position for grinding the work W by the grinding whetstones 3 and the position for holding the work W by the support pads 43*a* and 43*b*, then the work W is bent between the holding position and the grinding position, causing problems including one that the degree of flatness lowers. Accordingly, the arrangement is made such that during the grinding of the work W, fluid, such as air, is supplied from the distance detection sensor holes 56 in the support pads 43*a* and 43*b*, and the distances between the work W and the support pads 43*a* and 43*b*, respectively, are detected on the basis of the air pressures by the distance detection means, so that on the basis of the results of detection, for example, the left-right positions of the left-hand and right-hand grinding whetstones 3 are controlled in such a manner that the distances between the work W and the support pads 43*a* and 43*b* are equal. In addition, the arrangement may be made such that the left-right positions of the work holding bodies 41*a* and 41*b*, not of the grinding whetstones 3, are adjusted.

When the work W is being ground, the pressure of the fluid supplied from the fluid supply holes 62 in the pockets 51 is kept constant. During the grinding of the work W, the friction between the grinding whetstones 3 and the work W heats the vicinity of the grinding whetstones 3 to a high temperature, the heat being transmitted from the peripheral edge of the whetstone-associated notches 44 to the support pads 43*a* and 43*b*. The heat transmitted to the support pads 43*a* and 43*b* tries to travel along the mesh section 52 by bypassing the pockets 51 filled with the fluid; therefore, on the inner peripheral edge 53*a* along the whetstone-associated notches 44, the gradients of the changes in temperature in the portion connected to the outer peripheral edge 53*b* at opposite ends of the whetstone-associated notches 44 and in the inside-and-outside connecting sections 52*a* leading to the inside veins 54 are lower than those in the other portions, producing a disturbance in the temperature distribution. And undulations are produced in the work W corresponding to the positions where the temperature distribution is disturbed.

Here, in the two-sided surface grinding apparatus 1 in this embodiment, since, on the inner peripheral edge 53*a* is provided an inside-and-outside connecting section 52*a* only in one place in the vicinity of the central position A, the places where a disturbance is produced in the temperature distribution are only (1) a connecting portion from the inner peripheral edge 53*a* at opposite ends of the whetstone-associated notch 44 to the outer peripheral edge 53*b* and (2) one inside-and-outside connecting section 52*a* in the vicinity of the central position A, that is, when seen in the radial direction of the work W, the vicinity of the central position A' and the vicinity of the outer peripheral edge (see FIG. 13). Thereby, the formation of undulations of concentric circles produced in the work W, which have been a problem in the conventional two-sided surface grinding apparatus, can be effectively prevented; thus, it has become possible to further improve the degree of flatness of the surfaces of the work W after grinding.

In addition, the reason for the formation of undulations in the work W is that some kind of physical force acts to bend the work W outwardly of the surfaces, such physical force being believed to have been produced correspondingly to the positions on the inner peripheral edge 53*a* where the temperature distribution is disturbed. In the two-sided surface grinding apparatus 1 of the present embodiment also, there still remain the places on the inner peripheral edge 53*a* where the temperature distribution is disturbed, and it is believed that some physical forces act on the work W correspondingly to such places. However, such places are found only in the positions corresponding to the vicinity of the central position of the work W and the vicinity of the outer peripheral edge, with no such place in their intermediate portions; thus, it is surmised that the spacing between the points of application of physical forces is wider than in the prior art, whereby the bending forces acting on the work W can be mitigated to suppress the undulations.

Further, since the fluid supply holes 62 in the pockets 51*a* and 51*b* provided along the whetstone-associated notches 44 are disposed concentratedly in the vicinities of the inside-and-outside connecting sections 52*a*, and the vicinity of the connection between the inner and outer peripheral edges 53*a* and 53*b*, it follows that the fluid supplied from these fluid supply holes 62 passes first through the vicinities of the inside-and-outside connecting sections 52*a*, etc., and can effectively cool the vicinities of the inside-and-outside connecting sections 52*a*, etc., making it possible to further suppress the undulations of concentric circles having been produced in the work W after grinding.

Further, since the pockets 51*a* and 51*b* provided along the whetstone-associated notches 44 are so formed as to be substantially equal in radial width along the peripheral direction of the whetstone-associated notches 44, that is, along the peripheral direction of the grinding whetstones 3, the thermal conduction characteristics around the peripheries of the whetstone-associated notches 44 can be made substantially constant along the whetstone-associated notches 44, thereby further suppressing the undulations of concentric circles having been produced in the work W after grinding.

Upon completion of the grinding of the work W, the drive motors 37 of the plate thickness measuring means 32 are actuated, so that the main bodies 35 move backward along the guide rails 34 through the racks 36, and the pair of left and right measuring arms 33, 33 in the rear of the main bodies 35 enter the plate thickness sensor notches 65 in the support pads 43*a* and 43*b*. And the work W is held between a pair of measuring ends 33*a*, 33*a* of said measuring arms 33, 33 from opposite surfaces, whereby the plate thickness of the work W after grinding is measured.

Upon completion of the plate thickness measurement of the work W by the plate thickness measuring means 32, the measuring arms 33 of the plate thickness measuring means 32 are retracted from the plate thickness sensor notches 65 in the support pads 43*a* and 43*b*. And, the grinding whetstones 3 are moved from the "grinding position" to the "waiting position", while the work holding body 41*b* is moved from a "grinding time position" to a "work mounting and dismounting time position," and the work W after grinding is taken out of the work fitting section 77 of the work holding carrier 74 and carried out.

FIG. 14 show by way of example the second embodiment of the invention, showing an example of the support pads 43*a* and 43*b* in which the portion of the inner peripheral edge 53*a* of the peripheral edge 53 which extends along the whetstone-associated notch 44 is not at all provided with any inside-and-outside connecting section 52*a*, which is a connecting portion to the inside vein 54.

The support pads 43*a* and 43*b* of this embodiment, as shown in FIG. 14, differ from the first embodiment in that it is one pocket 51 alone that is disposed along the whetstone-associated notch 44. Employing such arrangement results in the enlargement of the region of the pocket 51, presenting drawbacks including one that the pressure distribution tends to be nonuniform in that region by an amount corresponding to the enlargement, but on the other hand it results in an arrangement in which the inside-and-outside connecting section 52*a* is not at all provided in the portion of the inner peripheral edge 53*a*, presenting an advantage that the undulations having been produced in the work W after grinding can be more reduced.

That is, if the arrangement in which the inside-and-outside connecting section 52*a* is not at all provided in the portion of the inner peripheral edge 53*a*, is employed, then the place where the temperature distribution is disturbed in the inner peripheral edge 53*a* is found only in connecting portions extending from the inner peripheral edge 53*a* at opposite ends of the whetstone-associated notch 44 to the outer peripheral edge 53*b*, that is, only in the position corresponding to the vicinity of the outer periphery of the work W. Therefore, the formation of undulations of concentric circles produced in the work W can be prevented more effectively than in the case of the first embodiment, making it possible to further improve the degree of flatness of the surfaces of the work W after grinding.

Embodiments of the invention have so far been described, but the invention is not limited thereto and the invention can be variously changed within the scope not departing from the spirit of the invention. For example, the shape of the noncontact support surfaces 45 in the support pads 43*a* and 43*b* may be such that the inside-and-outside connecting sections 52*a* are not provided in the portion of the peripheral edge 53 which extends along the whetstone-associated notch 44, excluding at least the vicinity of the central position A' of the work W, that is, in the portion excluding the vicinity of the central position A, other conditions being optionally set. For example, the pockets 51 may be provided in three or more rows (three layers) radially of the whetstone-associated notch 44, while the shape, disposition, etc., of the pockets 51 in and after the second row (second layer) from the whetstone-associated notches 44 are optional.

The work rotation support means for rotatably supporting the work W is not limited to the one using the work holding carrier 74 shown in the embodiment. For example, an arrangement may be employed in which the outer edge of the work W is directly held by three or more support rollers or the work W may be directly driven for rotation by and one of these support rollers or by a drive roller other than said support rollers.

Further, in the case of rotatably supporting the work W by using the work holding carrier, the shape, etc., and the drive mechanism therefor are optional. For example, the outer periphery of the work holding carrier may be formed with external teeth with which the drive gear 79 meshes.

As to the arrangement of the work drive device 2 except the support pads 43*a* and 43*b*, and the arrangement of the whetstone device 4, those shown in the embodiment may be suitably changed.

In the embodiments, an example of a two-sided surface grinding apparatus with its grinding whetstones 3 opposed to each other in the left-right direction. However, the invention is also applicable to another two-sided surface grinding apparatus constructed, for example, with its grinding whetstones 3 disposed vertically opposed to each other.

The invention claimed is:

1. A two-sided surface grinding apparatus comprising a pair of grinding whetstones rotatably supported with their grinding surfaces opposed to each other, a work rotation support means for supporting thin sheet-like work for rotation around a rotation axis parallel with the rotary shafts of said grinding whetstones in such a manner that at least parts of the grinding subject surfaces on the opposite surfaces are disposed in a grinding position between said grinding surfaces, and a pair of noncontact support means which are disposed so as to hold substantially the entire surface of a region outwardly of said grinding position in the grinding subject surfaces of said work and which noncontactly support said work by fluid pressure, the grinding subject surfaces on the opposite surfaces of said work being ground by rotating both said work and said grinding whetstones with said work supported by said noncontact support means, said noncontact support means being formed with substantially arcuate notches corresponding to said grinding whetstones at least over the central position of said work from their substantially circular outer edges, the noncontact support surfaces opposed to said work being provided with a plurality of pockets recessed therein and being provided with a single or a plurality of fluid supply holes in the inner wall thereof for discharging said fluid and also being provided with a netlike mesh section forming banks around the peripheries of said pockets, said mesh section being composed of peripheral edges disposed along the outer peripheries of the noncontact support surfaces and inside veins disposed so as to divide the region of the inside of the peripheral edges into a plurality of sections and connected to the peripheral edges in a plurality of inside-and-outside connecting sections, the portion of said peripheral edge which extends along said notches not being provided with said inside-and-outside connecting sections at least in the region excluding the vicinity of the central position of the work.

2. A two-sided surface grinding apparatus as set forth in claim 1, wherein said peripheral edge is such that an inner peripheral edge provided along said notch and an outer peripheral edge other than the same are connected together at opposite ends of said notch and said fluid supply holes in said pockets provided along said notch are disposed in the vicinity of said inside-and-outside connecting sections and in the vicinity of the connecting section between the inner and outer peripheral edges.

3. A two-sided surface grinding apparatus as set forth in claim 1 or 2, wherein said pockets provided along said notch are so formed as to be substantially equal in radial width along the peripheral direction of the grinding whetstones.

4. A two-sided surface grinding apparatus as set forth in claim 1 or 2, wherein other pockets than those provided along said notch are divided by the portions of said inside veins which are disposed radially of said work.

* * * * *